US009403637B2

(12) United States Patent
Aronoff et al.

(10) Patent No.: US 9,403,637 B2
(45) Date of Patent: Aug. 2, 2016

(54) ARTICLE AND METHOD FOR STORAGE AND TRANSPORT OF PAINTING IMPLEMENTS DURING USE

(71) Applicant: 8146896 Canada Inc., Saint Leonard (CA)

(72) Inventors: Eric Aronoff, Saint-Leonard (CA); Pierre Desjarlais, Boisbriand (CA)

(73) Assignee: 8146896 Canada Inc., Saint Leonard, Quebec (CA)

( * ) Notice: Subject to any disclaimer, the term of this patent is extended or adjusted under 35 U.S.C. 154(b) by 329 days.

(21) Appl. No.: 13/856,659

(22) Filed: Apr. 4, 2013

(65) Prior Publication Data

US 2013/0277257 A1 Oct. 24, 2013

Related U.S. Application Data

(60) Provisional application No. 61/636,794, filed on Apr. 23, 2012.

(51) Int. Cl.

| | |
|---|---|
| ***B44D 3/00*** | (2006.01) |
| ***B65D 85/00*** | (2006.01) |
| ***B44D 3/12*** | (2006.01) |

(52) U.S. Cl.

CPC ..... *B65D 85/00* (2013.01); *B44D 3/126* (2013.01)

(58) Field of Classification Search

CPC ..... B65D 85/00; B44D 3/12; B44D 3/14; B44D 3/125; B44D 3/122; B44D 3/126; B44D 3/00

USPC ..... 206/45.2, 1.8, 1.9, 1.7, 373, 372; 220/570, 459.02, 733, 23.83, 23.86, 220/23.87; D32/53.1

See application file for complete search history.

(56) References Cited

U.S. PATENT DOCUMENTS

| | | | | |
|---|---|---|---|---|
| 4,998,696 | A * | 3/1991 | Desjardins | 248/146 |
| 5,738,241 | A * | 4/1998 | McEntee | 220/532 |
| 6,196,410 | B1 * | 3/2001 | Hocking | B44D 3/126 206/209 |
| 7,424,959 | B1 * | 9/2008 | Biebel | B44D 3/126 15/257.06 |
| 2003/0006156 | A1 * | 1/2003 | McCracken | B44C 7/02 206/373 |
| 2006/0108192 | A1 * | 5/2006 | Bastarache | 190/18 A |
| 2008/0042035 | A1 * | 2/2008 | Elwood | 248/346.03 |
| 2009/0127266 | A1 * | 5/2009 | Arvinte et al. | 220/570 |
| 2010/0108685 | A1 * | 5/2010 | Mills, II | 220/553 |
| 2011/0297685 | A1 * | 12/2011 | Sorenson | B44D 3/127 220/570 |

* cited by examiner

*Primary Examiner* — Steven A. Reynolds

(74) *Attorney, Agent, or Firm* — Rosenberg, Klein & Lee

(57) ABSTRACT

Painters employ multiple painting implements during painting which must be moved around as they move or stored during painting as activities are paused temporarily. Accordingly it would be beneficial to provide a painting transportation and storage system that met such requirements. However, as painters seek to minimize expenses by buying those paint trays on special offer, disposable paint tray liners, quart or gallon paint cans for small painting jobs, etc. it would be beneficial for such a system to provide flexibility in handling paint cans as well as paint trays, different sizes of paint cans, variations in paint tray dimensions, etc as well as providing an easily maneuvered system during their painting session to reflect their motion and areas being painted that can be quickly closed at the end of a painting session or their change of paint.

10 Claims, 15 Drawing Sheets

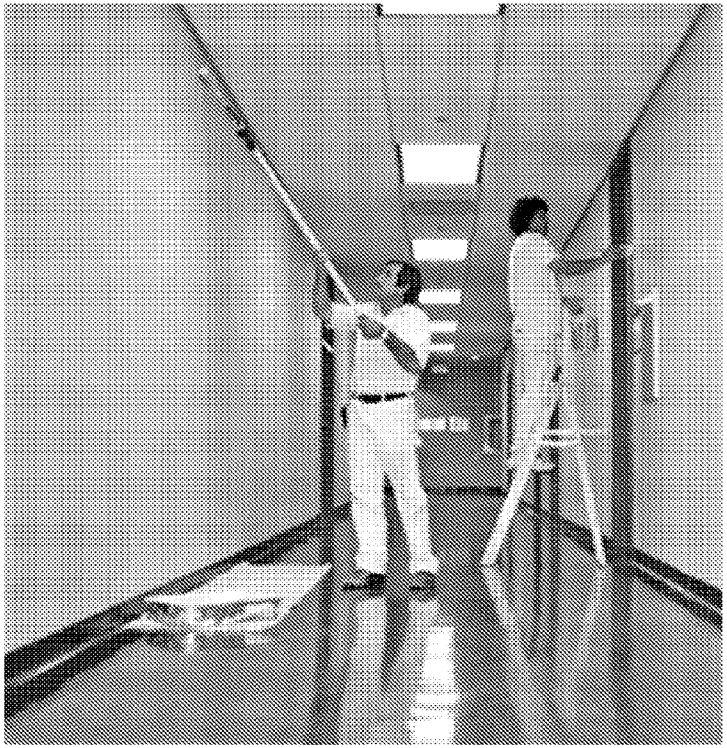
PRIOR ART
Figure 1
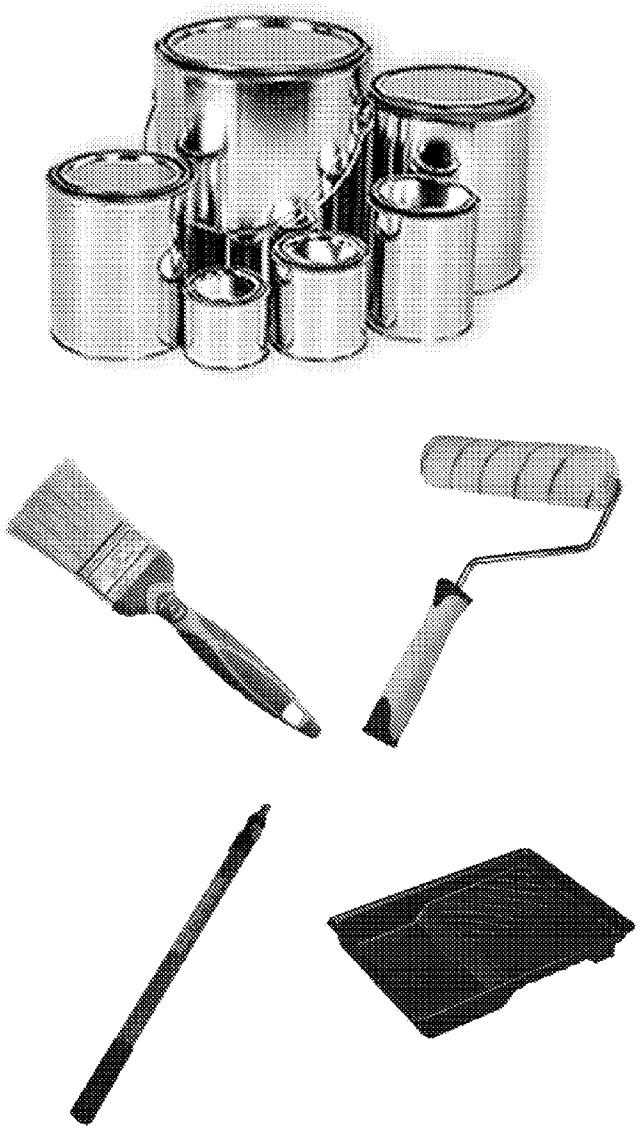

PRIOR ART

PRIOR ART

PRIOR ART

ARTICLE AND METHOD FOR STORAGE AND TRANSPORT OF PAINTING IMPLEMENTS DURING USE

FIELD OF THE INVENTION

The present invention relates to the painting industry and more specifically to the provisioning of painting implements.

BACKGROUND OF THE INVENTION

Painting is the practice of applying paint, pigment, color or other medium to a surface (support base). The medium is commonly applied to the base with a brush but other objects can be used including rollers and sprayers. Painting is also used to define a common trade among craftsmen and builders. Painters require many tools in their activities including paint, brushes, and paint rollers are required as are paint trays and paint cans together with other items which may include drop-clothes, scrapers, tape, and screwdrivers. Irrespective of the medium and surface it is very difficult even for professional craftsmen to easily manage these items during their painting activities especially when painting a large room, corridor etc.

At the end of a day's painting activities the painter then performs a series of cleanup activities such as cleaning their brush or brushes, cleaning the roller, and washing the paint tray. Either that or they dispose of them all and begin the next day with new implements that are expensive and not environmentally conscious. Accordingly it would be beneficial to provide the painter with a system that provides them with the ability to easily move their painting implements around during their time painting as well as managing their painting implements for a period of time after a painting session so that they do not need to spend time cleaning before finishing that painting session or disposing of their implements after the session and using new implements in the next session.

Within the prior art systems for the storage and management of painting implements such as presented by R. Mill in U.S. Patent Application 2010/0,108,685 "Paint Assembly"; D. Bastarache in U.S. Patent Application 2006/0,108,192 "Painter's Container"; J. K. Verbrugge et al in U.S. Patent Application 2005/0,098,564 "Packaging for Paint Comprising Lid with Integral Roller Tray"; M. G. McKenna in U.S. Pat. No. 4,903,869 "Brush Storage and Fluid Dispensing Device"; and R. A. Heisler in U.S. Pat. No. 3,828,389 "Unitary Container having a Hinged Panel with a Tray Configuration" suffer drawbacks from the painter's viewpoint. Amongst these are limitations in handling painting implements between painting sessions without cleaning them, restrictions on replacing elements within the systems, and flexibility.

Typically, painters will seek to minimize expenses such buying those paint trays on special offer, using disposable paint tray liners, using quart paint cans for small painting jobs, etc. Accordingly it would be beneficial to provide painters with a system that provided flexibility in handling paint cans as well as paint trays, different sizes of paint cans, variations in paint tray dimensions, etc as well as providing an easily maneuvered system during their painting session to reflect their motion and areas being painted that can be quickly closed at the end of a painting session or their change of paint.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate disadvantages of the prior art and provide improvements to the painting industry and more specifically to the provisioning of painting implements.

In accordance with an embodiment of the invention there is provided a method comprising providing

- a first element comprising at least a top surface, a bottom surface, and at least one first feature of a plurality of first features forming part of the top surface and having a first predetermined footprint and first depth, each first feature dimensioned according to a standard paint can type;
- a second element comprising at least a recess of predetermined dimensions to accept a paint tray; wherein
  - in a first configuration the second element sits atop the top surface of the first element thereby allowing a painter to access the paint tray within the recess; and
  - in a second configuration the first element sits atop the second element such that the recess is covered and the paint tray enclosed.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 1 depicts typical painting elements of a painter and a painting environment according to the prior art;

DETAILED DESCRIPTION

Figure 2:
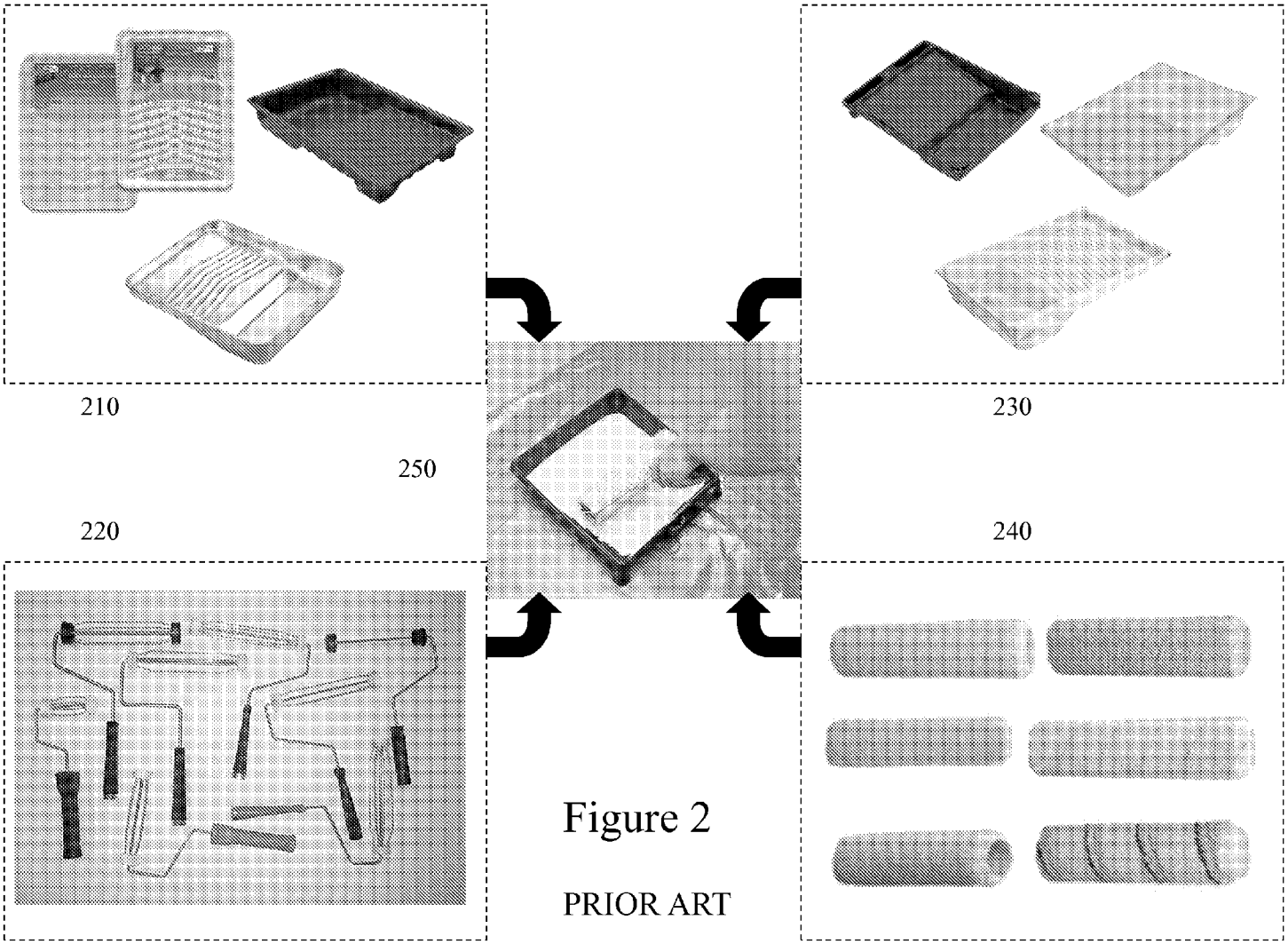
Figure 2 PRIOR ART
FIG. 2 depicts the variations in paint rollers and paint trays available to a painter that impact a painting transportation and storage system according to an embodiment of the invention.

The present invention is directed to the painting industry and more specifically to the provisioning of painting implements.

The ensuing description provides exemplary embodiment(s) only, and is not intended to limit the scope, applicability or configuration of the disclosure. Rather, the ensuing description of the exemplary embodiment(s) will provide those skilled in the art with an enabling description for implementing an exemplary embodiment. It being understood that various changes may be made in the function and arrangement of elements without departing from the spirit and scope as set forth in the appended claims.

PAINT: Paint is any liquid, liquefiable, or mastic composition which after application to a substrate in a thin layer is converted to an opaque solid film. The common constituents of paint are pigments, binder, solvent, and additives.

Pigments are granular solids incorporated into the paint to contribute color, toughness, texture, give the paint some special properties or simply to reduce the cost of the paint. Alternatively, some paints contain dyes instead of or in combination with pigments. Pigments can be classified as either natural or synthetic types. Natural pigments include various clays, calcium carbonate, mica, silicas, and talcs. Synthetics would include engineered molecules, calcined clays, blanc fixe, precipitated calcium carbonate, and synthetic pyrogenic silicas. Hiding pigments, in making paint opaque, also protect the substrate from the harmful effects of ultraviolet light and include titanium dioxide, phthalo blue, red iron oxide, and many others. Fillers are a special type of pigment that serve to thicken the film, support its structure and simply increase the volume of the paint. Fillers are usually made of cheap and inert materials, such as diatomaceous earth, talc, lime, barytes, clay, etc. Floor paints that will be subjected to abrasion may even contain fine quartz sand as a filler. Not all paints include fillers whilst some paints contain very large proportions of pigment/filler and binder.

The binder, commonly referred to as the vehicle, is the actual film forming component of paint. It is the only component that must be present whereas other components listed below are included optionally, depending on the desired properties of the cured film. The binder imparts adhesion, binds the pigments together, and strongly influences such properties as gloss potential, exterior durability, flexibility, and toughness. Binders include synthetic or natural resins such as cement, alkyds, acrylics, vinyl-acrylics, vinyl acetate/ethylene (VAE), polyurethanes, polyesters, melamine resins, epoxy, or oils and are categorized according to drying, or curing mechanism. The four most common are simple solvent evaporation, oxidative crosslinking, catalyzed/cross linked polymerization, and coalescence.

Latex paint, which is the dominant paint type within residential and general commercial applications, is a water-borne dispersion of sub-micrometre polymer particles. The term "latex" in the context of paint simply means an aqueous dispersion and are generally prepared by emulsion polymerization. Latex paints cure by a process called coalescence where first the water, and then the trace, or coalescing, solvent, evaporate and draw together and soften the latex binder particles and fuse them together into irreversibly bound networked structures, so that the paint will not re-dissolve in the solvent/water that originally carried it.

Besides the three main categories of ingredients, paint can have a wide variety of miscellaneous additives, which are usually added in very small amounts and yet give a very significant effect on the product. Some examples include additives to modify surface tension, improve flow properties, improve the finished appearance, increase wet edge, improve pigment stability, impart antifreeze properties, control foaming, control skinning, etc. Other types of additives include catalysts, thickeners, stabilizers, emulsifiers, texturizers, adhesion promoters, UV stabilizers, flatteners (de-glossing agents), biocides to fight bacterial growth, and the like. Additives normally do not significantly alter the percentages of individual components in a formulation STAIN: A stain, typically employed on wood, consists of a colorant suspended or dissolved in a 'vehicle' or solvent. The suspension agent can be water, alcohol, petroleum distillate, or the actual finishing agent (shellac, lacquer, varnish, polyurethane, etc.). Colored or 'stained' finishes, like polyurethane, do not penetrate the pores of the wood to any significant degree and will disappear when the finish itself deteriorates or is removed intentionally. Two types of colourants are used, pigments and dyes. The difference is in the size of the particles. Dyes are microscopic crystals that dissolve in the vehicle and pigments are suspended in the vehicle and are much larger. Dyes will color very fine grained wood, like cherry or maple, which pigments will not. Those fine-grained woods have pores too small for pigments to attach themselves to. Pigments contain a binder to help attach themselves to the wood.

The type of stain will either accentuate or obscure the wood grain and neither is superior to the other. Most commercial stains contain both dye and pigment and the degree to which they stain the appropriate wood is mostly dependent on the length of time they are left on the wood. Pigments, regardless of the suspension agent, will not give much color to very dense woods but will deeply color woods with large pores (e.g. pine). Dyes are translucent and pigments are opaque. Gel stains are more akin to paint and have little penetrating ability SEALANT: A sealant may be viscous material that has little or no flow characteristics and wither stays where it is applied or is thin and runny so as to allow it to penetrate the substrate by means of capillary reaction. Anaerobic acrylic sealants generally referred to as impregnants are the most desirable as they are required to cure in the absence of air, unlike surface sealants that require air as part of the cure mechanisum that changes state to become solid, once applied, and is used to prevent the penetration of air, gas, noise, dust, fire, smoke or liquid from one location through a barrier into another. Typically, sealants are used to close small openings that are difficult to shut with other materials, such as concrete, drywall, etc. Desirable properties of sealants include insolubility, corrosion resistance, and adhesion. Uses of sealants vary widely and sealants are used in many industries, for example, construction, automotive and aerospace industries.

PAINTING IMPLEMENTS: Painters typically apply paint using direct manual application through use of paint brushes and paint rollers or through spraying. In manual application the painter will repeatedly insert the painting implement, e.g. paint brush or paint roller, into the liquid paint and apply the liquid paint transferred to the surface being painted before repeating the process. At the beginning of painting the painter will open the container containing the paint and either inserts the bristles of the paint brush directly into the paint within the container or into paint within another paint container, such as a paint tray, into which the paint has been decanted from the original paint container. If using a paint roller then the painter will have decanted the paint into a paint tray as generally paint rollers which are designed to increase speed of painting are wider than the original container of paint.

Paint Brush: The sizes of brushes used for painting and decorating are given in given in millimeters or inches, and refers to the width of the head of the paint brush. Common sizes are ⅛ in, ¼ in, ⅜ in, ½ in, ⅝ in, ¾ in, ⅞ in, 1 in, 1¼in, 1½ in, 2 in, 2½ in, 3 in, 3½ in, and 4 in (10 mm, 20 mm, bob 40 mm, 50 mm, 60 mm, 70 mm, 80 mm, 90 mm, 100 mm). In some instances the end of the brush has bristles providing a predetermined geometry, e.g. a tapered length across the width of the brush (commonly known as chiseled), to enhance their use in certain painting situations such as defining edges and tight corners or painting more precisely. Bristles may be natural or synthetic material. If the filaments are synthetic, they may be polyester, nylon or a blend of nylon and polyester. Filaments can be hollow or solid and can be tapered or untapered, wherein brushes with tapered filaments give a smoother finish. Handles may be wood or plastic whilst the ferrules that surround and grip the filaments whilst attaching to the handle are metal, usually nickel-plated steel.

Paint Roller: A paint roller is a paint application tool used for painting large flat surfaces rapidly and efficiently and typically consists of two parts: a "roller frame," (commonly referred to as a cage) and a "roller cover" (commonly referred to as a cover or roller cover). The roller cover absorbs the paint and transfers it to the painted surface. The roller frame attaches to the roller cover. A painter holds the roller by the handle section. The roller frame is reusable. It is possible to clean and reuse a roller cover, but it is also typically disposed of after use. Paint rollers are also particularly suited for texture painting where the roller cover has texture which may be for example from pile fabric covering secured to a cylindrical core or through physical surface height variations with foam rubber rollers are also made. Rollers may be specified by their length, inner diameter and hence the roller cage they are compatible with, and the depth of the pile where provided (commonly referred to as the nap). Common roller lengths are 4", 6", 6½", 7½", 9½", 14", and 18" (100 mm, 150 mm, 165 mm, 190 mm, 240 mm, 305 mm, and 457 mm) whilst common naps are ¼", ⅜", ¾", 1" (6 mm, 9.5 mm, 19 mm, 25 mm) where shorter naps tend to result in smoother painted surfaces. Paint rollers may also be mounted to the end of extending poles thereby allowing high surfaces to be painted without requiring the painter employ a ladder or such a high ladder.

PRIOR ART: Referring to FIG. 1 there are depicted painting implements for painters including paint brush, paint roller, extending pole, and paint tray together with paint cans providing different quantities of paint according to the type of paint and/or quantity purchased including for example pint, quart, gallon, and 5 gallon. Also depicted is a typical commercial painting application wherein the painters are painting a large area along an extended surface, in this case the walls of a corridor. Now referring to FIG. 2 there is depicted an example of the complexity of managing painting implements for a painter with respect to paint trays and paint rollers. As depicted a painter may select a paint tray 210, a paint tray liner 230, a paint roller cage 220, and paint roller 240 to provide the painting combination 250 they use. However, whilst paint rollers 240 and paint roller cages 220 are essentially standardized there is no such standardization in paint trays 210 and paint tray liners 230.

Accordingly the paint trays 210 vary in materials, e.g. aluminum, light sheet steel, and plastic as well as outer dimensions of length, width, height together with some having projections to support placement on ladders. Similarly, paint tray liners vary in dimensions and materials, which although typically plastic, means that the thickness of the paint liner trays may vary substantially. Accordingly some paint tray liners may be sufficiently rigid that painters may use discretely without a supporting paint tray. It would therefore be evident that painters will typically over a reasonable period of time exhibit little brand loyalty as such painting implements will be purchased on aspects such as ease of availability and cost.

Figure 3:
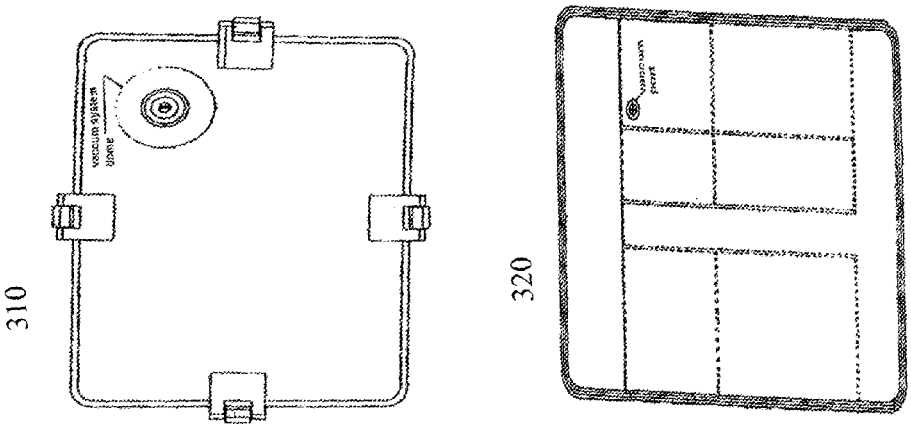
FIG. 3 depicts a painting transportation and storage system according to the prior art of Mill in US Patent Application 2010/0,108,685.
Figure 3:
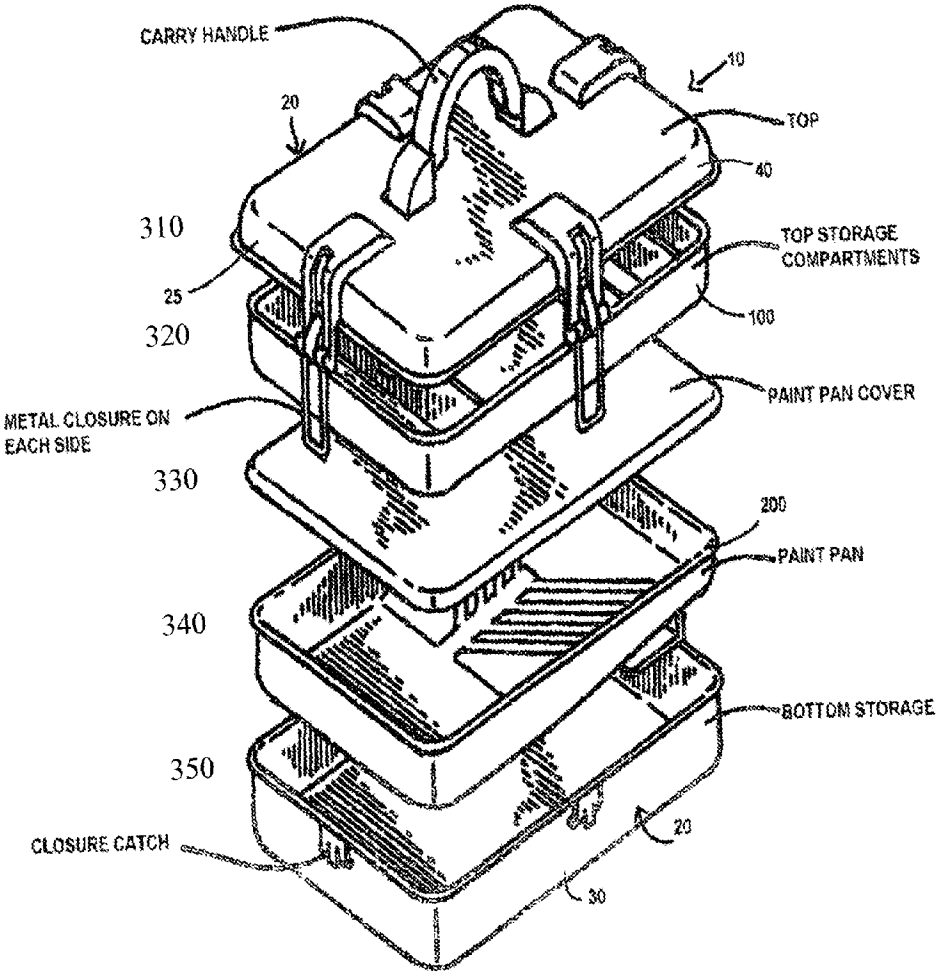

Referring to FIG. 3 there is depicted a painting transportation and storage system (PTSS) according to the prior art of Mill in US Patent Application 2010/0,108,685. Mill teaches to a stackable storage system comprising lid 310, top storage section 320, tray cover 330, paint tray 340, and bottom storage section 350. Each of the lid 310, top storage section 320, and tray cover 330 have pneumatic fittings such that when stacked together with the paint tray 340 and bottom storage section 350 and the catches are closed a vacuum pump can be attached to remove the air within the lid 310, top storage section 320, tray cover 330, and paint tray 340 so that, according to Mill, paint within these elements does not harden between painting sessions. However, it would be evident that the system has multiple points of failure due to dependency on multiple seals, pneumatic fittings, and catches. For example, a single drop of paint into the orifice of the pneumatic fitting on the tray cover 330 may block this unknown to the painter such that the paint tray 340 does not get pumped down. It would also be evident that the system would have a high retail price and does not benefit the painter substantially during painting apart from providing a paint tray.

Figure 4:
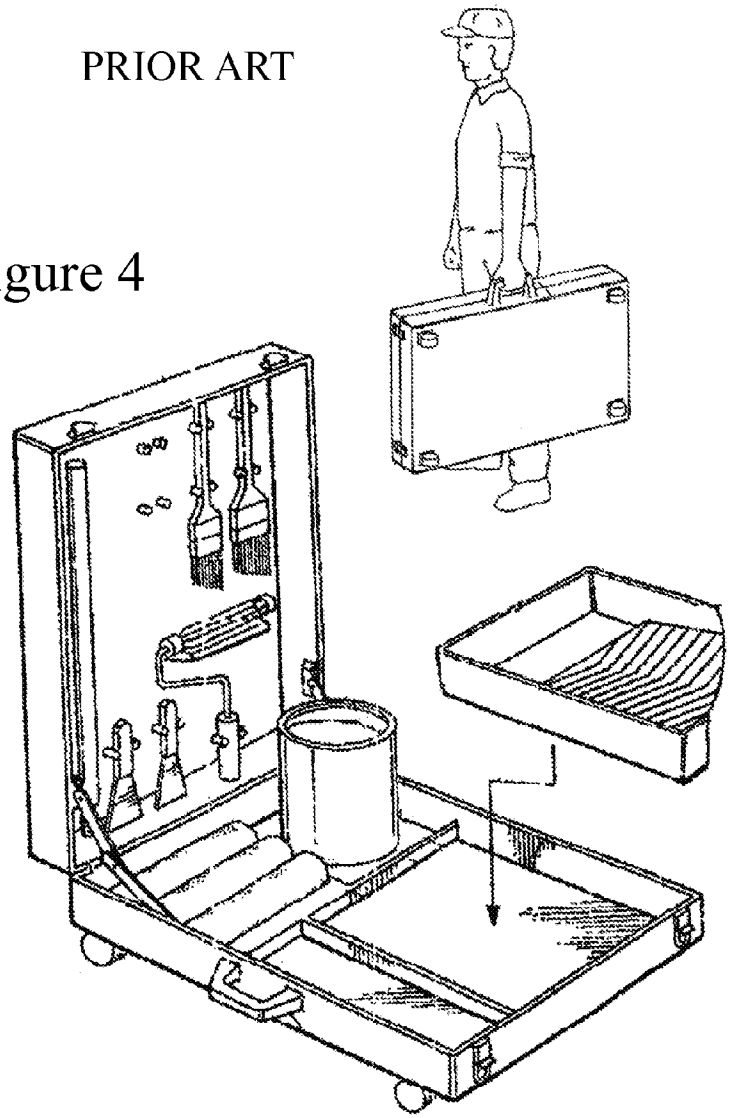
FIG. 4 depicts a painting transportation and storage system according to the prior art of Bastarche in US Patent Application 2006/0,108,192.

Referring to FIG. 4 there is depicted a PTSS according to the prior art of Bastarche in US Patent Application 2006/0,108,192. As depicted the system comprises an enclosure comprising base and lid that are hinged along one edge. Within each of the lid and base are fittings allowing the painter to store paint brushes, paint rollers, paint roller cages, paint scrapers, and paint tray. The enclosure has wheels allowing it to be moved but only with a large vertical element of the lid. It would be evident that the enclosure is intended to be employed with clean implements as the tray is turned onto its side for transportation. Further the enclosure does not provide means to accommodate different sizes of paint tray. Accordingly, Bastarche teaches to an equivalent of a decorators pasting table that is transported between locations as the painter moves from one job to another rather than supporting storage during painting sessions associated with a single painting contract or job.

Figure 5:
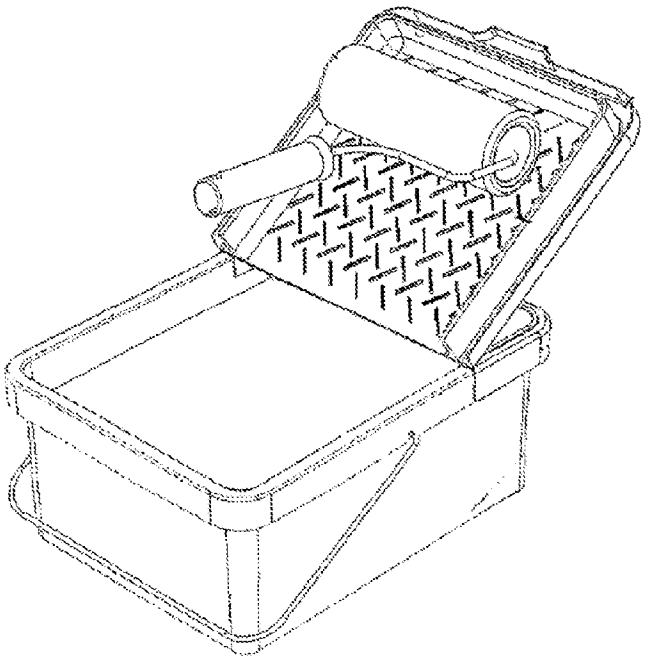
Figure 5 PRIOR ART
FIG. 5 depicts a painting transportation and storage system according to the prior art of Verbrugge in US Patent Application 2005/0,098,564.

FIG. 5 depicts a PTSS according to the prior art of Verbrugge in US Patent Application 2005/0,098,564 wherein a paint container has a folding lid which when opened and supported provides a paint tray-like surface for a roller. The container of Verbrugge being provided with paint either through a decanting process from a paint can or as part of the supply process wherein the container is provided with the paint at the time of purchase by the painter or another person purchasing the paint for the painter. The container of Verbrugge does not allow a painter to exploit low cost disposable paint tray liners such that the container overall is essentially disposed of then the paint within it is consumed, where it is procured with the paint inside at the time of purchase or when the painter has finished with that paint colour.

Figure 6:
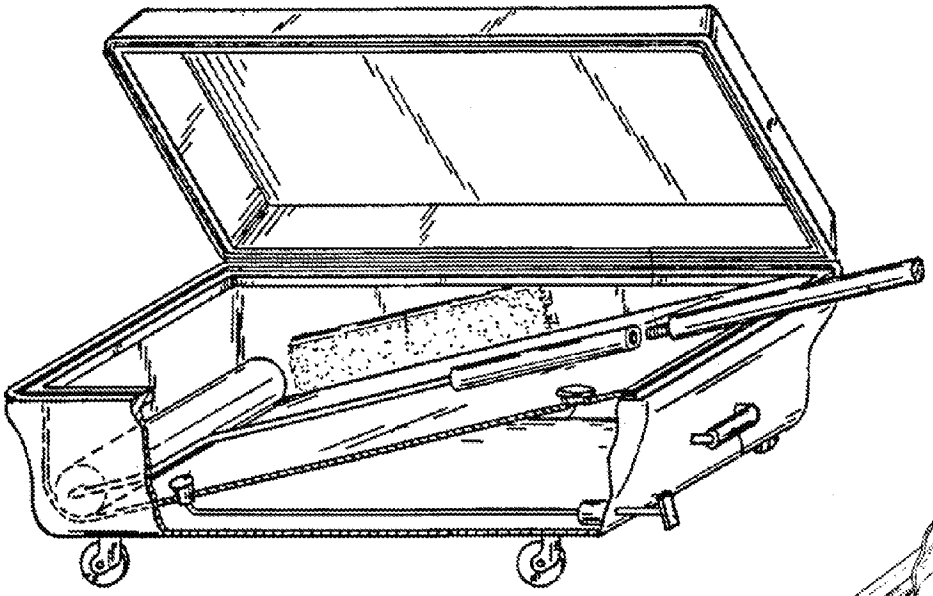
Figure 6 PRIOR ART
FIG. 6 depicts a painting transportation and storage system according to the prior art of McKenna in U.S. Pat. No. 4,903,869.

Now referring to FIG. 6 there is depicted a PTSS according to the prior art of McKenna in U.S. Pat. No. 4,903,869. McKenna teaches to a paint tray with a lid wherein the paint tray comprises towards the bottom at one end a user controlled valve such that paint from a reservoir beneath the paint tray may flow into the paint tray. Accordingly, as with Verbrugge the reservoir may be filled after purchase of the paint tray by decanting paint from a paint can or be purchased pre-filled. The container of McKenna like that of Verbrugge does not allow a painter to exploit low cost disposable paint tray liners such that the container overall is essentially disposed of then the paint within it is consumed, where it is procured with the paint inside at the time of purchase or when the painter has finished with that paint colour.

Figure 7:
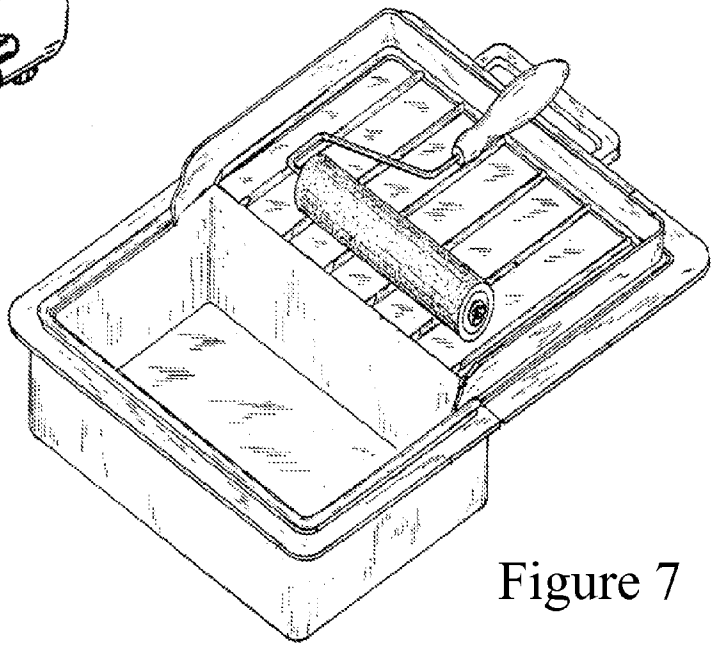
FIG. 7 depicts a painting transportation and storage system according to the prior art of Heisler in U.S. Pat. No. 3,828,389.

Referring to FIG. 7 there is depicted a PTSS according to the prior art of Heisler in U.S. Pat. No. 3,828,389 which is similar to that of Verbrugge in that a container is provided with a hinged lid that when opened on its inner surface provides the painter with a surface akin to a paint tray. Accordingly, Heisler suffers the same drawbacks as that of Verbrugge.

Accordingly it is evident that the prior art whilst attempting to address some of the requirements of painters each solution has drawbacks in terms of cost, implementation, usability etc that have meant that today no such system is currently available for consumer or commercial painters.

PAINTING IMPLEMENT MANAGEMENT SYSTEM: Accordingly when painting the painter must repeatedly insert/remove/apply their chosen paint applicator, be it a paint roller (referred to within this specification as a roller) or paint brush (referred to within this specification as a brush). This may require repeated decanting of paint from the paint container, commonly referred to as a paint can when containing a quart or gallon of paint and a paint drum when containing five (5) gallons of paint, to another container which is typically a paint tray which provides a first region for paint and a second region allowing the roller to be rolled such that a uniform application, or near uniform application, of paint is on the roller prior to rolling it onto the surface being painted.

Figure 8:
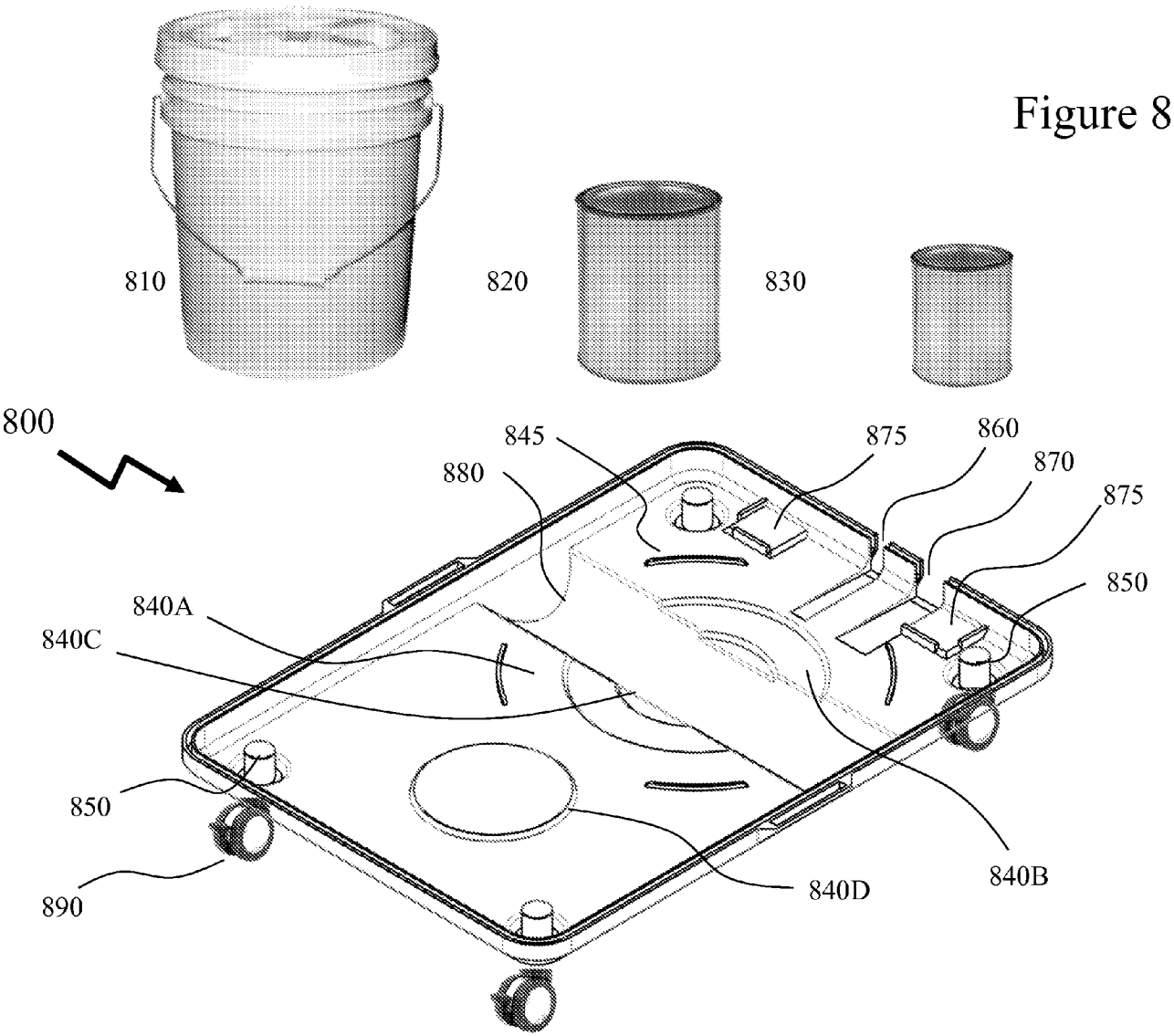
FIG. 8 depicts an element of a painting transportation and storage system according to an embodiment of the invention in a first configuration.

Referring to FIG. 8 there is depicted a first element 800 of a painting transportation and storage system (PTSS) according to an embodiment of the invention in a first configuration. As depicted first element 800 comprises an essentially rectangular plate tray with four mounting points 850 which may for example have inserted into them rollers 890 or another means of providing low friction motion of the first element 800 across a floor of an area being painted by a painter. Formed within the first element 800 are a plurality of features whose dimensions are based upon standard paint cans including first region 840A defined by four ridged protrusions 845 that are dimensioned according to the base of a five (5) gallon paint drum 810 (or can). Also disposed circularly symmetric with first region 840A are second and third regions 840B and 840C respectively which are recessed into the first element surface to accept the base of one (1) gallon and quart paint cans 820 and 830 respectively. Also disposed within first element 800 is fourth region 840D comprising a raised region which is similarly dimensioned to fit within the recess on the bottom of a quart paint can 830.

Also included with the first element 800 is a recess 880 across the width of the first element 800 through the portion comprising first to third regions 840A through 840C wherein the recess 800 accommodates a paint roller with or without the paint roller cage. By dimensioning the first element 800 according to intended application the recess 880 may accept multiple paint rollers wherein increasingly larger first elements 800 support more of the standard roller options discussed above that are 6½", 7½", 9½", 14", and 18" wide. For example, a consumer orientated PTSS may provide for paint rollers up to 14" whilst a commercial PTSS may support 18" paint rollers. Where the painter wishes to place a paint roller into the recess 880 with the paint roller cage and its corresponding handle then first edge element 870 provides means for the handle of the paint roller cage to be restrained whilst laying in a plane substantially that of the first element 800. Second edge element 860 adjacent provides for support and restraint of a paint brush. Disposed along the same edge of the first element 800 are lipped recesses 875 that are designed to accept the flanges on the bottom of a paint tray such that a paint tray may be disposed on the first element 800. However, as will be discussed below these lipped recesses 875 also provide a means of engaging another element of the PTSS which may be placed atop the first element 800.

Figure 9:
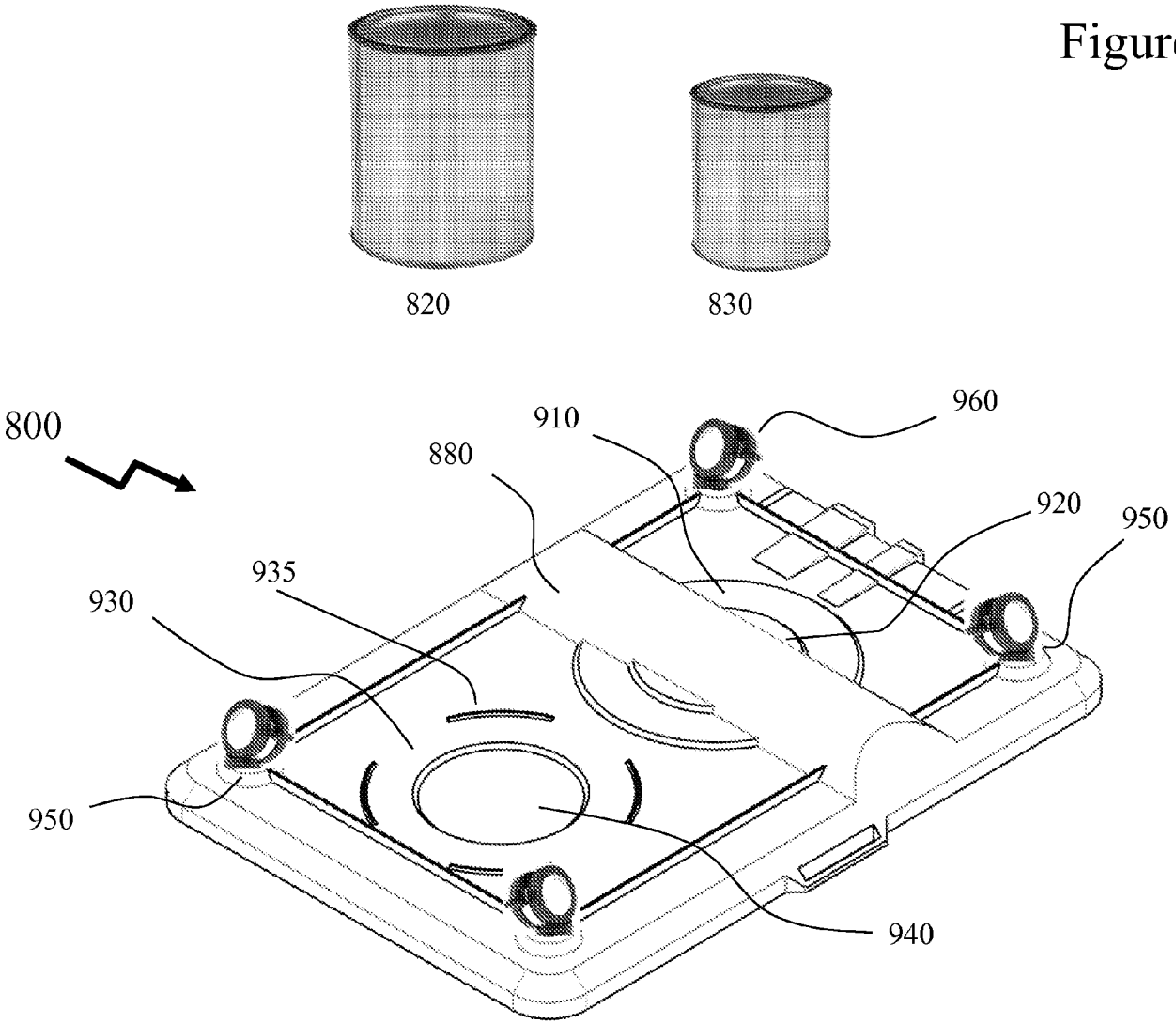
FIG. 9 depicts an element of a painting transportation and storage system according to an embodiment of the invention in a second configuration.

Optionally the first and second edge elements 870 and 860 respectively may be designed to hold the items away from the surface of the first element 800 such that for example the brush does not develop a flat portion from the weight of the bristles and paint pushing it down against the first element 800. Likewise first edge element 870 may cooperate with additional features within recess 880 that keep the surface of the roller away from the surface of the recess 880 such that the roller does not develop a Now referring to FIG. 9 there is depicted the first element 800 of a PTSS according to an embodiment of the invention in a second configuration. In this instance the first element 800 has been inverted such that the rollers 960 in the four mounting locations 950 are upwards and the first element 800 now slides based upon the friction between the edges of the first element 800 and the surface onto which it is placed. These edges may for example be simply molded plastic where the first element 800 has been injection molded and the edges left as formed or they may have additional elements such as low friction silicone coatings. It is also evident on the lower surface of first element 800 where the recess 880 for the paint roller is positioned together with the first and second raised regions 910 and 920 respectively that correspond to the second and third regions 840B and 840C respectively as depicted within FIG. 8. Likewise third region 940 now corresponds to recess whereas in FIG. 8 it was depicted as fourth region 840D. Accordingly third region 940 by suitable dimensioning may accept the base of a quart paint can 830. Circularly symmetrically disposed to third region 940 are projections 935 that define a fourth region 930 that fits the bottom of a one (1) gallon paint can 820.

Figure 10:
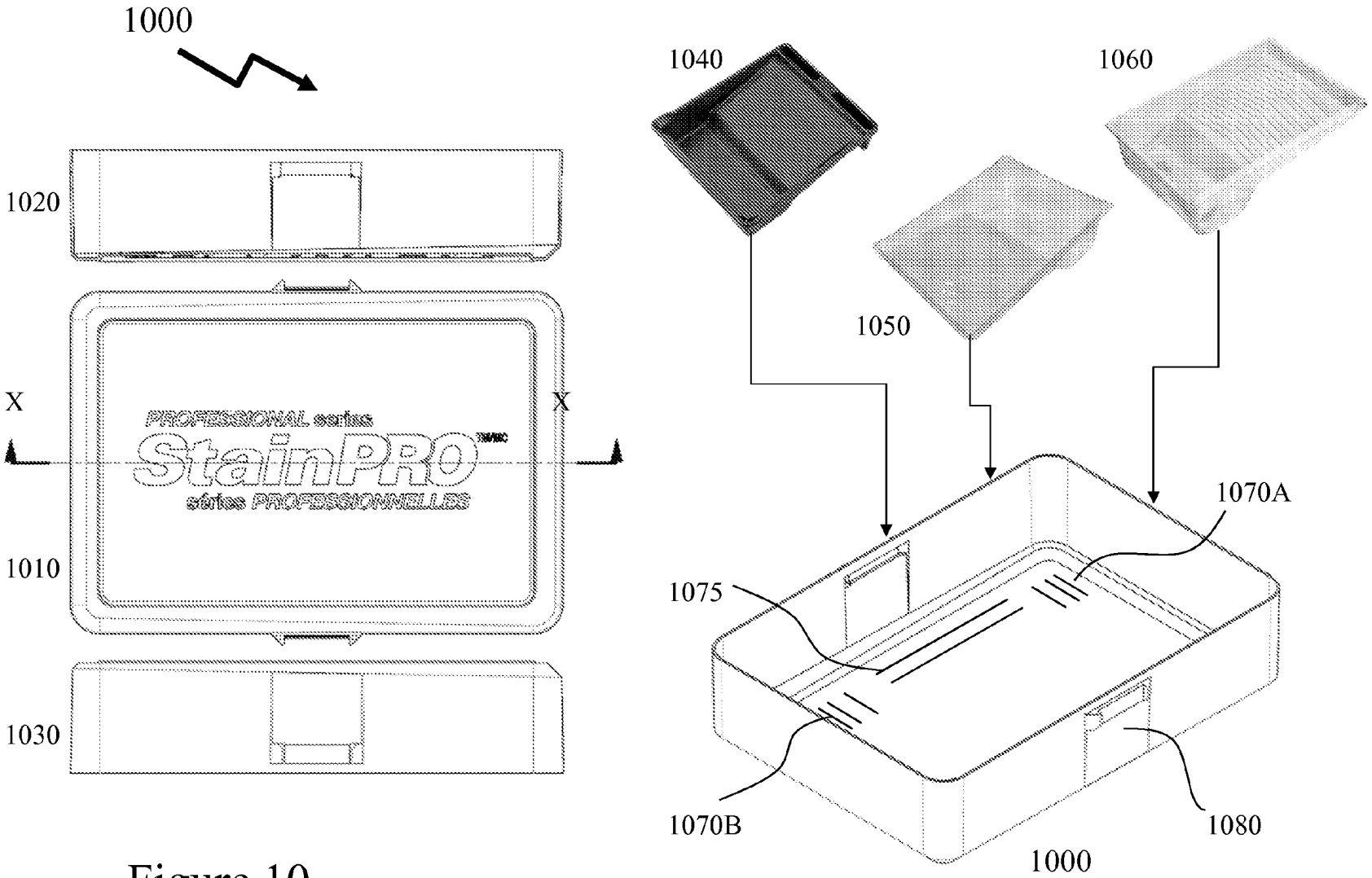
FIG. 10 depicts an element of a painting transportation and storage system according to an embodiment of the invention in a third configuration.

Referring to FIG. 10 there is depicted a second element 1000 for a PTSS according to an embodiment of the invention in a third configuration. First to third images 1010 to 1030 respectively depict the second element 1000 as essentially a deep rectangular tray. Within the perspective view the features 1080 on the sides of the second element 1000 can be seen to be recessed grips for a painter to pick the second element 1000 up. Disposed within the base of the second element 1000 are first and second end projections 1070A and 1070B respectively at the short edges whilst disposed along predetermined portions of the longer edges first and second groups of side projections are disposed although only first side projections 1075 are visible within the perspective view. Accordingly, the second element 1000 may hold within it a paint tray such as first to third trays 1040, 1050, and 1060 respectively wherein according to the dimensions of the paint tray base it will be retained from sliding by one or more projections on the base comprised from the first and second end projections 1070A and 1070B respectively, and first side projections 1075, and second side projections.

It would be evident to one skilled in the art that the paint tray may be a paint tray, a paint tray liner, or a combination of paint tray and paint tray liner. Accordingly, the painter may employ a resilient paint tray with thin flexible paint tray liners which may be disposed of at the end of painting with a particular colour whilst the more expensive resilient paint tray remains within the second element 1000 ready to accept another paint tray liner.

Figure 11:
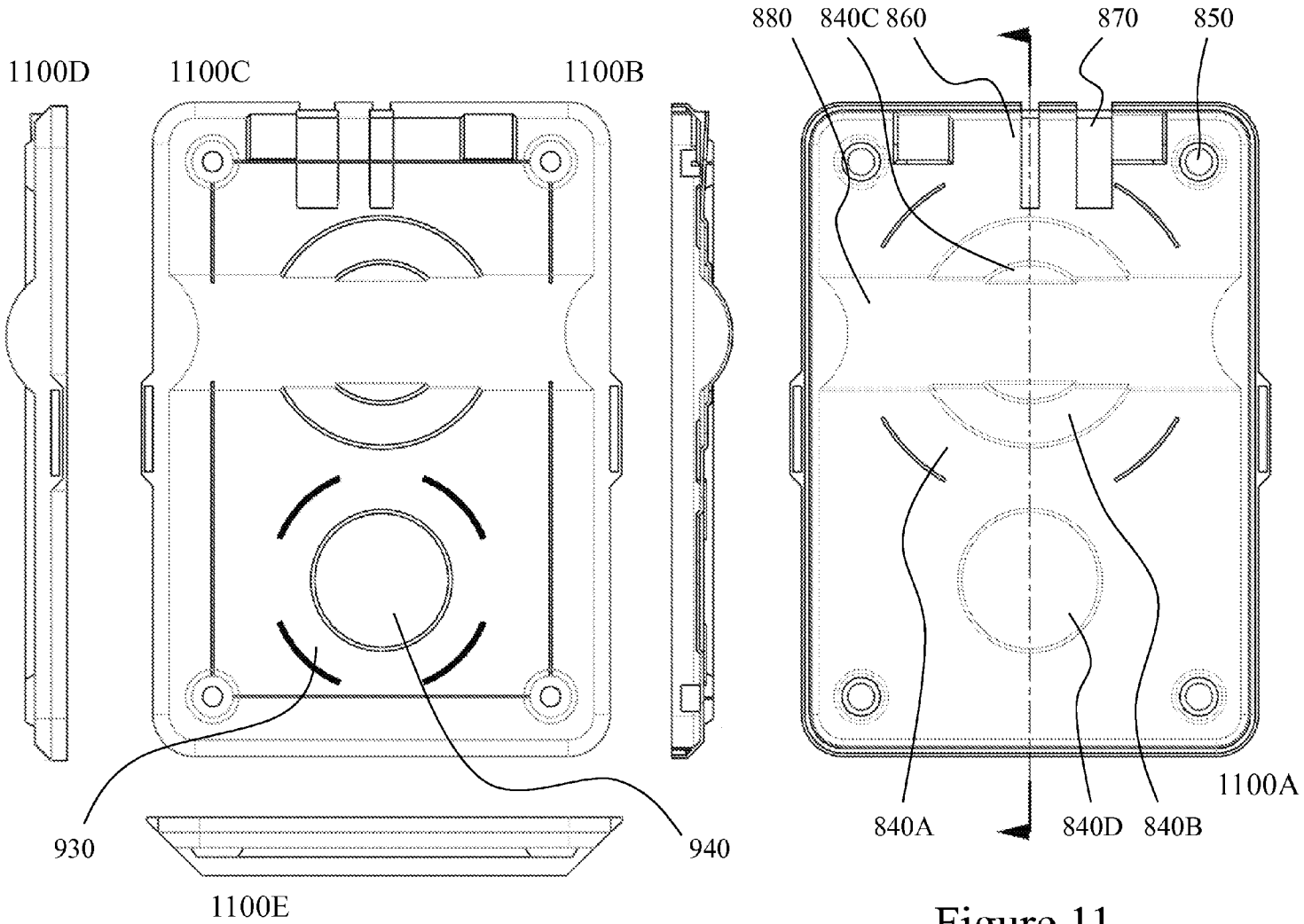
FIG. 11 depicts the element of a painting transportation and storage system according to an embodiment of the invention as described in respect of FIGS. 8 and 9.

Referring to FIG. 11 there are depicted bottom view 1100C, first and second side elevations 1100D and 1100B respectively, end elevation 1100E, and plan view 1100A. Within plan view 1100A the plurality of features whose dimensions are based upon standard paint cans are shown including first region 840A dimensioned according to the base of a five (5) gallon paint drum 810 (or can), second and third regions 840B and 840C respectively which are recessed into the first element surface to accept the base of one (1) gallon and quart paint cans 820 and 830 respectively, and fourth region 840D comprising a raised region which is similarly dimensioned to fit within the recess on the bottom of a quart paint can 830. Also shown are mounting points 850, recess 880 for a paint roller, first edge element 870 for the handle of the paint roller cage, and second edge element 860 for support and restraint of a paint brush.

Figure 12:
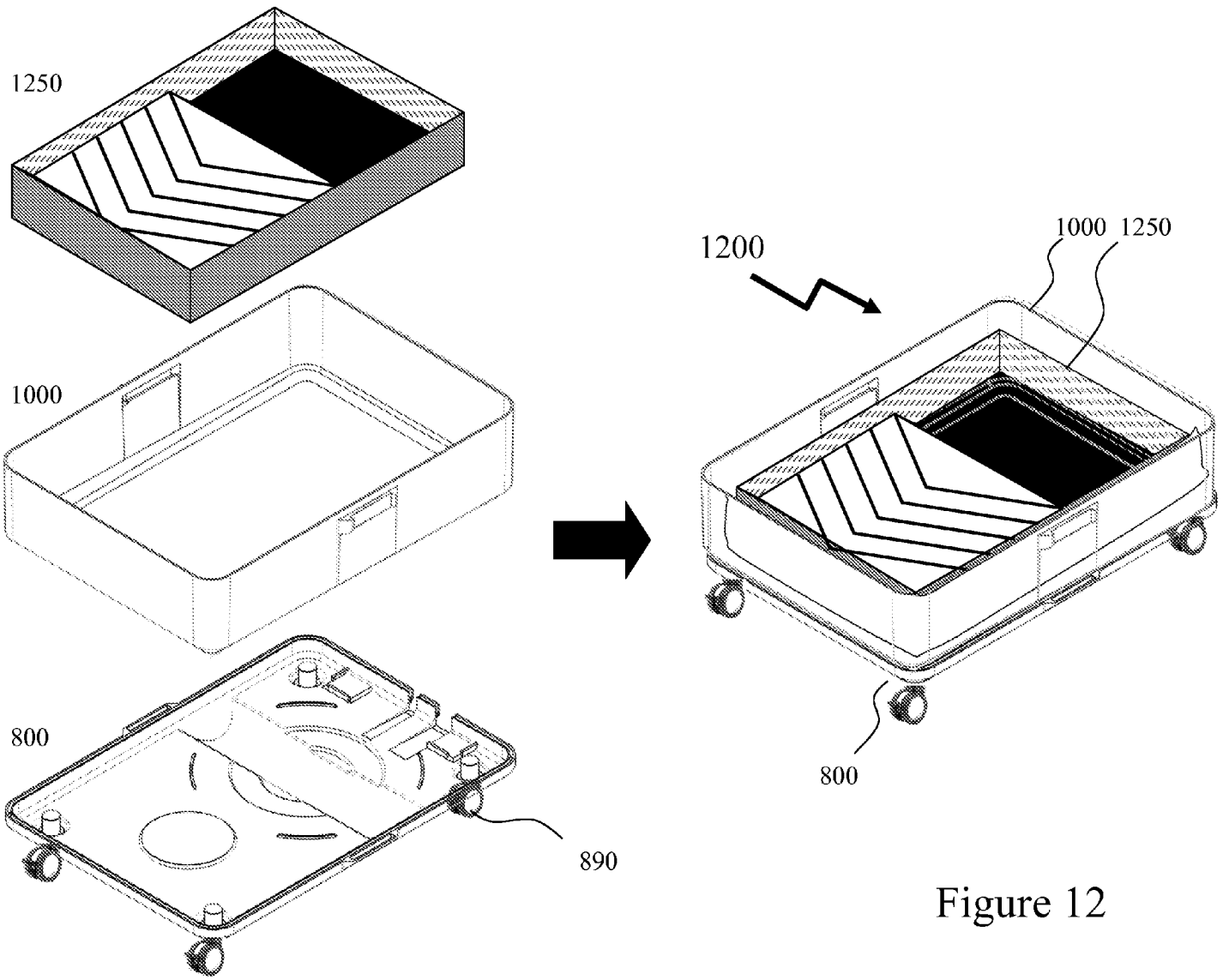
FIG. 12 depicts a painting transportation and storage system according to an embodiment of the invention in a fourth configuration.

Referring to FIG. 12 there is depicted a PTSS according to an embodiment of the invention in a fourth configuration 1200 wherein first element 800, second element 1000, and a paint tray 1250 are combined such that the paint tray 1250 is inserted within second element 1000 and these are then mounted atop the first element 800. Accordingly in this configuration the painter may utilize the paint tray 1250 and easily move this around using the rollers 890. If the painter in pouring paint from a paint can into the paint tray 850 spills then this is contained within the second element 1000.

Figure 13:
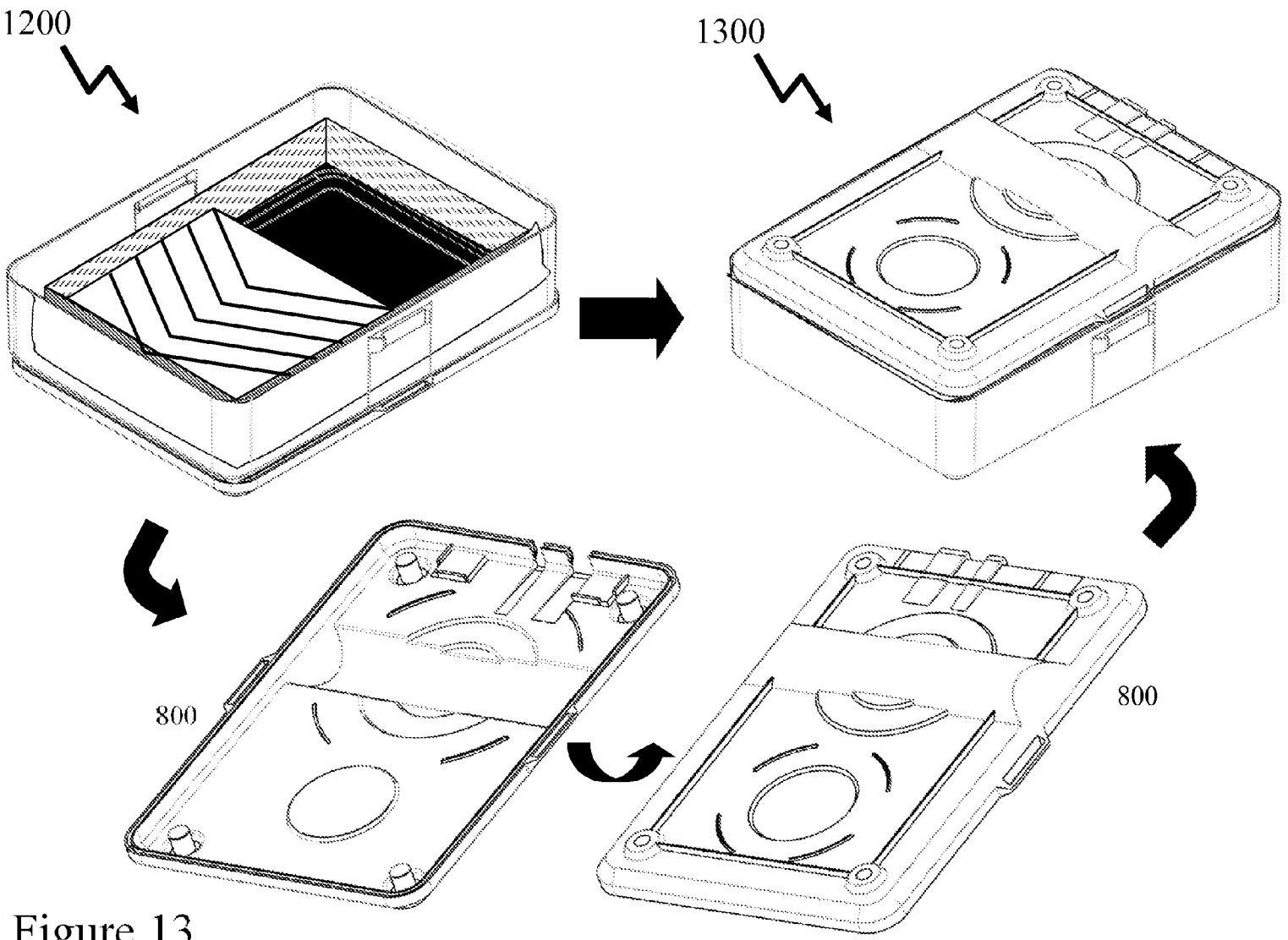
FIG. 13 depicts a painting transportation and storage system according to an embodiment of the invention in use and storage configurations.

Now referring to FIG. 13 there is depicted a PTSS according to an embodiment of the invention in use and storage configurations 1200 and 1300 respectively. In use configuration 1200 being first element 800, second element 1000, and a paint tray 1250 provides an easily maneuvered paint tray. When the painter has finished this painting session, for example at the end of a day, they remove the second element 1000 using the features 1080, as depicted in FIG. 10 but not identified for clarity in this Figure, with the paint tray 1250 within and any paint therein which they then place onto the floor. They then take the first element 800 and invert before placing this on top of the second element 1000 thereby enclosing the paint tray 1250. The resulting assembly can then be picked up using features 1080 and transported. The first and second elements 800 and 1000 may be secured together using one or more of the methods well known within the art including case catches for example.

Accordingly the resulting storage configuration 1300 provides a closed container that is easily transported by the painter or left ready for the next painting session wherein the painter removes the first element 800, inverts and then places second element 1000 onto it. It would be evident that depending upon the roller design for rollers disposed on the bottom of first element 800, such as rollers 890, that the rollers may either project significantly above the inverted surface of the first element 800 or be essentially co-planar with the surface of the inverted first element 800. For example caster type rollers would project but rollers based upon balls with sockets, for example like a trackerball within a mouse, would be essentially co-planar with the surface. Low profile roller designs may provide benefit in some instances by being installed prior to shipment of the first element 800.

Figure 14:
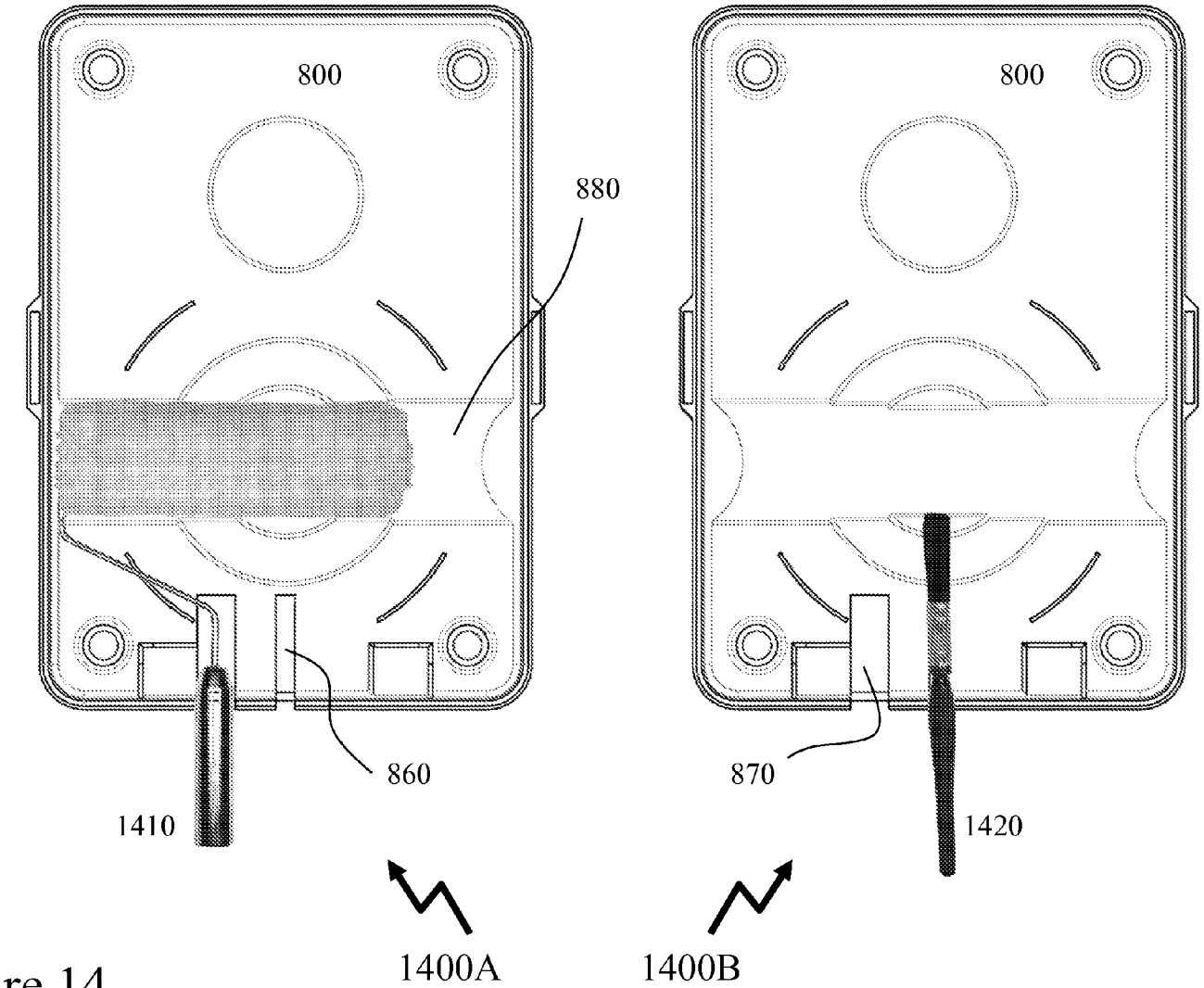
FIG. 14 depicts a painting transportation and storage system according to an embodiment of the invention for storing different painting implements.

Now referring to FIG. 14 there is depicted a first element 800 of a PTSS according to an embodiment of the invention in first and second configurations 1400A and 1400B for storing painting implements. In first configuration 1400A a paint roller 1410 is disposed within the first element 800 such that the paint roller 1410 has the head sitting within the recess 880 and the handle within first edge element 870. In second configuration 1400B a paint brush 1420 is disposed within the first element 800 by having the handle disposed within second edge element 860. It would be evident to one skilled in the art that first and second edge elements 870 and 860 respectively may have structures formed or provided down the edges of the first element 800 material forming first and second edge elements 870 and 860 respectively to retain the roller handle or paint brush handle. Such structures may include brushes, rubber strips, polymeric strips, etc such that the painting implement is inserted with some pressure into the structure and retained by friction.

Figure 15:
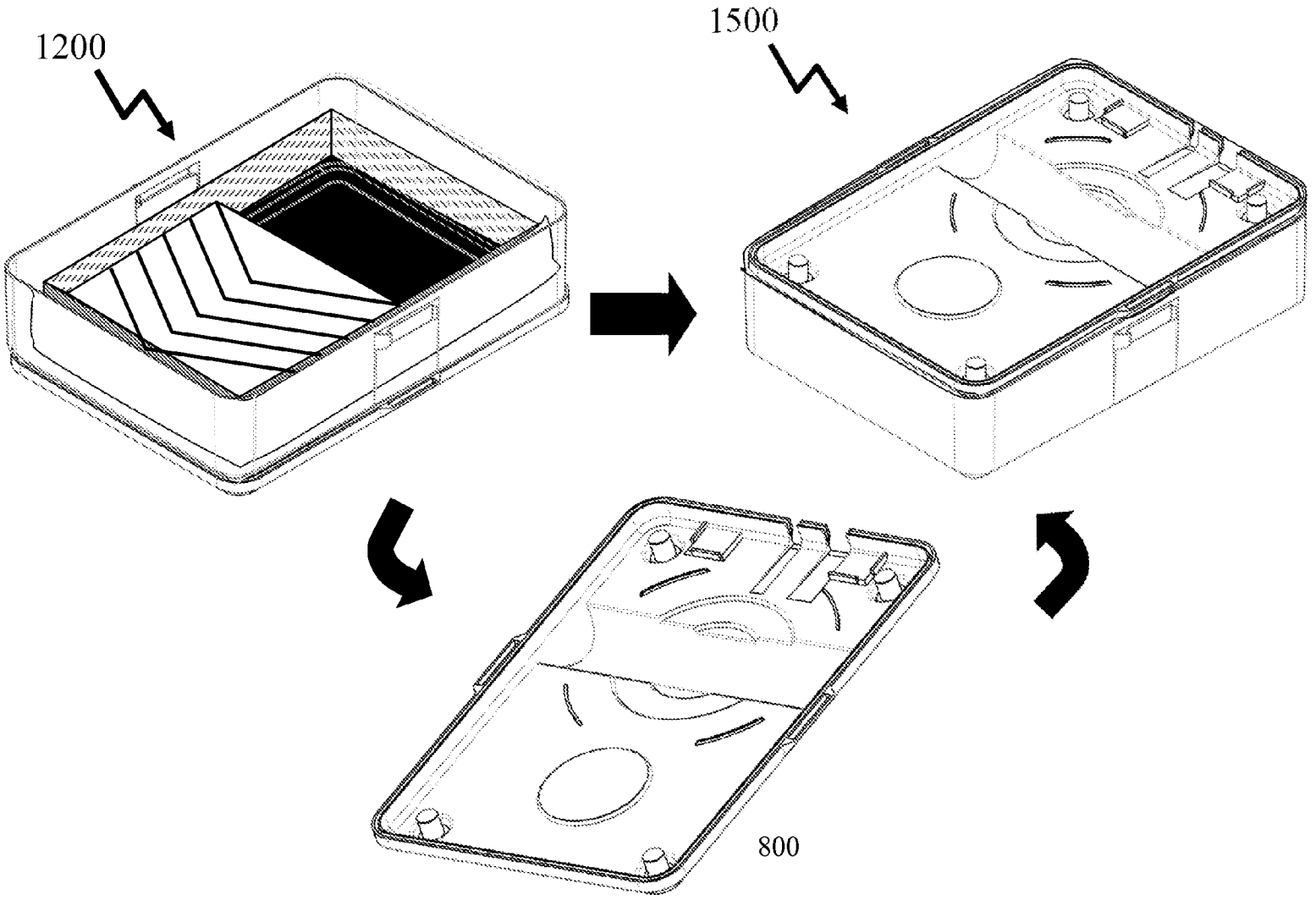
FIG. 15 depicts a painting transportation and storage system according to an embodiment of the invention in use and storage configurations.

Now referring to FIG. 15 there is depicted a PTSS according to an embodiment of the invention in use and storage configurations 1200 and 1500 respectively. In use configuration 1200 being first element 800, second element 1000, and a paint tray 1250 provides an easily maneuvered paint tray. When the painter has finished this painting session, for example at the end of a day, they remove the second element 1000 using the features 1080, as depicted in FIG. 10 but not identified for clarity in this Figure, with the paint tray 1250 within and any paint therein which they then place onto the floor. They then take the first element 800 and place this on top of the second element 1000 thereby enclosing the paint tray 1250. The resulting assembly can then be picked up using features 1080 and transported.

The first and second elements 800 and 1000 may be secured together using one or more of the methods well known within the art including case catches for example. Accordingly the resulting storage configuration 1500 provides a closed container that is easily transported by the painter or left ready for the next painting session wherein the painter removes the first element 800, inverts and then places second element 1000 onto it. Within this assembly approach for the first and second elements 800 and 1000 respectively rollers with reasonable depth and hence projection away from the surface of the first element 800 are now between the first element 800 and second element 1000 so that they are inaccessible and not accidentally caught when the user moves the storage configuration 1500.

It would be evident to one skilled in the art that a PTSS according to embodiments of the invention may be formed from two injection molded elements, the first element 800 and second element 1000 which either have locking features formed therein during molding or attached subsequently to retain the first element 800 onto the second element 1000 in the "closed" configuration wherein the first element is disposed atop the second element 1000.

Figure 16:
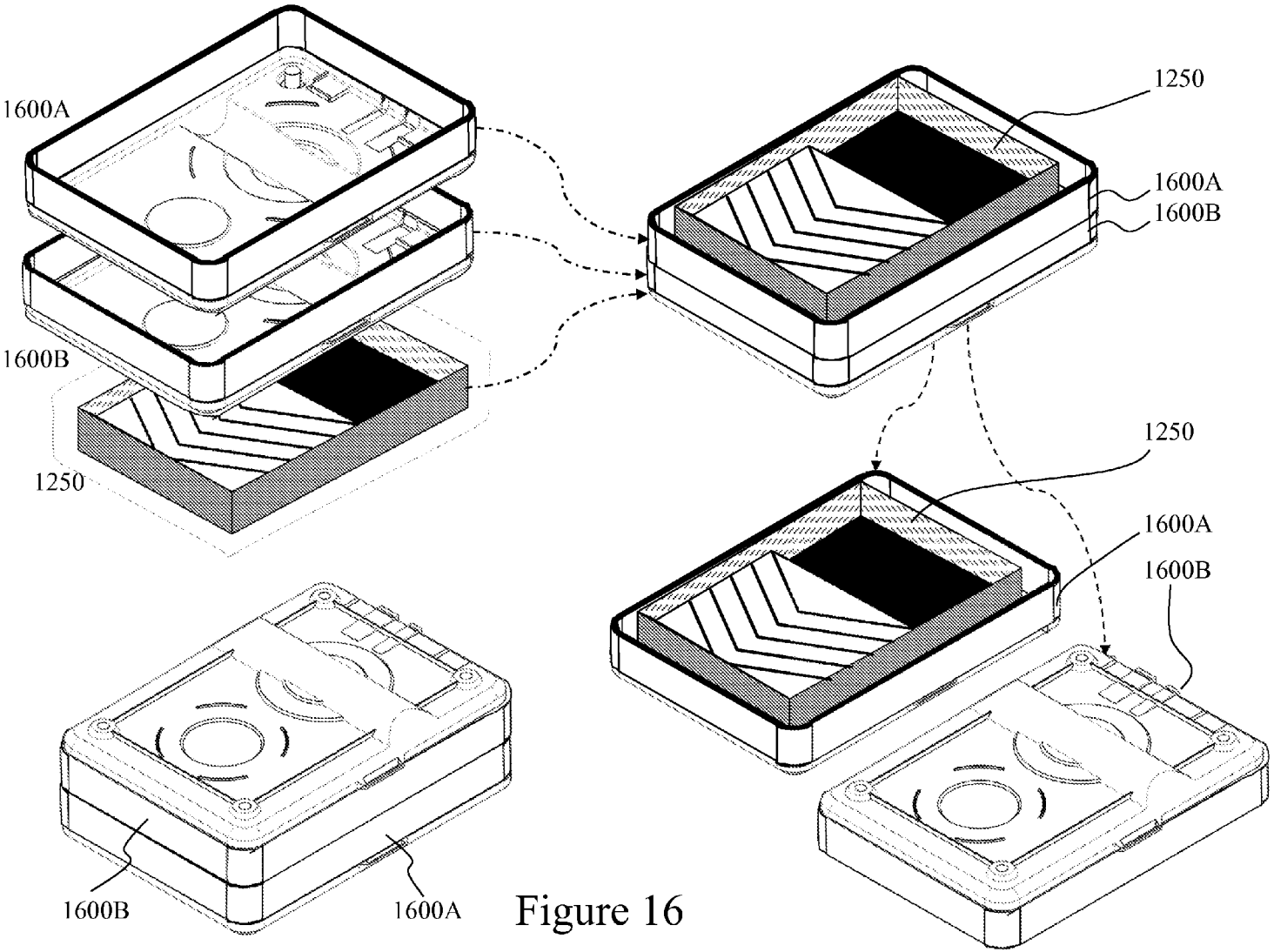
FIG. 16 depicts a painting transportation and storage system according to an embodiment of the invention in different use and storage configurations.

Now referring to FIG. 16 there is depicted a PTSS according to an embodiment of the invention in purchase, use and storage configurations by virtue of a schematic flow. Accordingly as depicted a user purchases a pair of elements, first and second elements 1600A and 1600B respectively, which are identical for use together with an existing paint tray 1250. Accordingly the user in use stacks first element 1600A inside second elements 1600B and places the paint tray 1250 within thereby allowing them to paint and in instances where the second element 1600B has rollers also roll the assembly around on the painting activity they are performing. When the user has finished this painting session, for example at the end of a day, they remove the first element 1600A and paint tray 1250 by picking up the first element 1600A using grip features provided for that purpose, e.g. features 1080 as described above in respect of FIG. 10. Next they invert the second element 1600B and subsequently place this onto the first element 1600A thereby enclosing the paint tray 1250. The resulting assembly can then be picked up using the matching grip features on second element 1600B and transported. Alternatively, the resulting assembly can be rolled into a corner or away based upon first element 1600A also having rollers.

The first and second elements 1600A and 1600B may be secured together using one or more of the methods well known within the art including case catches for example which may be implemented as one per pair of parallel edges for example such that upon combination the first and second elements 1600A and 1600B have catches on all four edges through the total of 4 catches between the two elements. Accordingly the resulting storage configuration 1500 provides a closed container that is easily transported by the painter or left ready for the next painting session wherein the painter undoes the catches, removes second element 1600B, inverts it and then places first element 1600A into it together with the paint tray 1250.

Alternatively, first and second elements 1600A and 1600B may be intended for 180° between them when mounted to provide the enclosure. It would be evident that in this approach first and second elements 1600A and 1600B are stackable and replaceable individually. Optionally, first and second elements 1600A and 1600B whilst stackable may have different features such that they are distinguishable elements and hence employed in particular manner. For example, in such a scenario second element 1600B may be absent features for retaining multiple paint trays or all sizes of paint and the features for holding the paint brush handle and roller cage handle.

Figure 17:
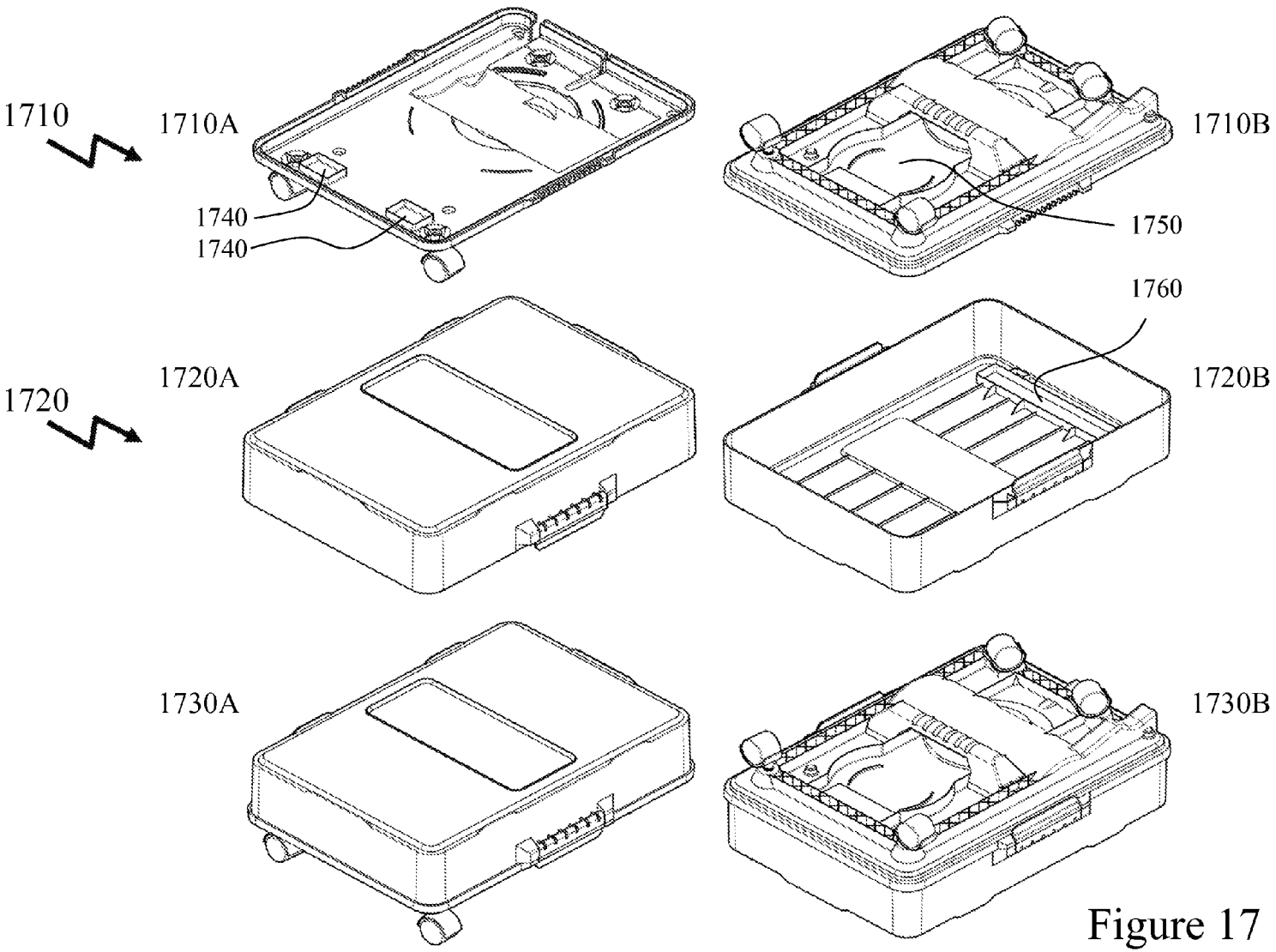
FIG. 17 depicts elements of a painting transportation and storage system according to an embodiment of the invention.

Now referring to FIG. 17 there are depicted elements of a PTSS according to an embodiment of the invention. As depicted a base element 1710 is shown in first and second orientations 1710A and 1710B respectively, base element 1710 being the wheeled base of the PTSS and accordingly comparable to first element 800 described supra in respect of FIGS. 8, 9, and 12 to 15 respectively. Also depicted is cover element 1720 shown in third and fourth configurations 1720A and 1720B respectively, cover element 1720 being comparable to second element 1000 described supra in respect of FIGS. 10 and 12 as well as second element 1600B in FIG. 16. Base and cover elements 1710 and 1720 respectively are shown assembled in fifth and sixth orientations 1730A and 1730B such as described supra in respect of 1300 in FIG. 13. As depicted the base element 1710 differs from first element 800 in that lipped regions 1740 are disposed at the other end than those depicted with first element 800 and lipped recesses 875. Similarly, fourth region 930 on first element 800 is now holder 1750 with raised sidewalls.

Within the descriptions above in respect of FIGS. 8 through 17 supra the descriptions may have been construed as being related to interior painting however the embodiments of the invention are applicable to interior and exterior painting as well as the interior/exterior application of stains and sealants together with other liquid coatings that may be applied to surfaces in conjunction with one or more of these. However, the PTSS depicted and described in respect of FIGS. 8 through 17 may also be employed in the application or dispersal of other materials including liquids, particulates, and powders for example wherein easy movement, application and storage are required. It would be evident that the overall design of the PTSS may be varied according to the type of application or that different PTSS products may be tailored to different applications as well as supporting additional equipment such as a compressor and liquid tank for spraying applications. Accordingly, features depicted as being circular to accommodate circular containers may be replaced with those of other geometries according to the containers of these other materials.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments. Implementation of the techniques, blocks, steps and means described above may be done in various ways.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be rearranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An assembly comprising:

a first element comprising at least:

a top surface;

a bottom surface;

at least one first feature of a plurality of first features forming part of the top surface, each first feature dimensioned according to a base of a predetermined standard paint can type, each first feature extending around and above a predetermined portion of the external periphery of the base of the predetermined standard paint can type in order to restrict motion of said predetermined standard paint can type when disposed upon the top surface; and at least one second feature of a plurality of second features forming part of the bottom surface, each second feature dimensioned according to a base of a predetermined standard paint can type, each second feature extends around and above a predetermined portion of the external periphery of the base of the predetermined standard paint can type in order to restrict motion of said predetermined standard paint can type when disposed upon the top surface;

a second element comprising at least a recess of predetermined dimensions to accept a paint tray; wherein in a first configuration of the assembly the second element is mounted stably upon the top surface of the first element thereby allowing a painter to access paint within the paint tray within the recess and stably slide the assembly across a surface;

in a second configuration of the assembly the first element is mounted stably upon the second element such that the recess is covered, the paint tray within the recess enclosed without emptying or spilling any paint within any paint tray, and the second element stably mounts upon a surface onto which the assembly is placed; and the top surface is approximately parallel to the surface onto which the assembly is placed in each of the first and second configurations.

2. The assembly according to claim 1, wherein in the second configuration the first element is inverted prior to placing it onto the second element such that the top surface of the first element is within the resulting enclosure formed by the first and second elements.

3. The assembly according to claim 1, wherein the second feature on the bottom surface is disposed opposite the first feature on the top surface.

4. The assembly according to claim 1, further comprising;

a recess formed within the top surface of the first element for accepting a paint roller up to a maximum predetermined width and maximum predetermined diameter when the first and second elements are in the second configuration; and an opening formed within the edge of the top surface of the first element to accept and retain a handle of the paint roller between the first and second elements when in the second configuration.

5. The assembly according to claim 1, wherein the first element comprises at least one low friction element of a plurality of low friction elements, each low friction element disposed in a predetermined position on the bottom surface of the first element such that the first element can be moved easily upon a surface upon which it rests with the top surface uppermost.

6. The assembly according to claim 1, wherein the second element comprises at least one protuberance of a plurality of protuberances, each protuberance formed in the base of the recess to laterally restrain motion of the paint tray when inserted into the recess such that the second element can accommodate a variety of paint trays of varying dimensions.

7. The assembly according to claim 1, wherein each first feature extends around and above a predetermined portion of the external periphery of the base of the predetermined standard paint can type in order to restrict motion of said predetermined standard paint can type when disposed upon the top surface.

8. The assembly according to claim 1, further comprising;

an opening formed within the edge of the top surface of the first element to accept and retain a handle of the painting implement disposed within a paint tray, wherein the handle is held between the first and second elements when in the second configuration.

9. The assembly according to claim 1, wherein the bottom surface of the first element incorporates a set of wheels; and when the assembly is in the first configuration a user can move the assembly across the surface on the set of wheels.

10. The assembly according to claim 1, wherein the top surface of the first element incorporates a first portion of a latching mechanism; and the top surface of the second element incorporates a second portion of a latching mechanism; wherein in the second configuration the first and second elements are joined by the latching mechanism which can be released to allow the assembly to be transitioned to the first configuration.

* * * * *